US006322394B1

(12) United States Patent
Katoh et al.

(10) Patent No.: US 6,322,394 B1
(45) Date of Patent: Nov. 27, 2001

(54) ELECTRICAL CONNECTOR HAVING A FIXING MECHANISM AND METHOD FOR MANUFACTURING SAID ELECTRICAL CONNECTOR

(75) Inventors: Satoshi Katoh; Takeshi Okuyama; Hideo Miyazawa, all of Tokyo (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 0 days.

(21) Appl. No.: 09/459,634

(22) Filed: Dec. 13, 1999

(30) Foreign Application Priority Data

Mar. 4, 1999 (JP) ..... 11-057613

(51) Int. Cl.[7] ..... H01R 13/648
(52) U.S. Cl. ..... 439/607
(58) Field of Search ..... 439/607

(56) References Cited

U.S. PATENT DOCUMENTS 5,037,330 * 8/1991 Fulponi et al. ..... 439/607
5,192,228 * 3/1993 Collins et al. ..... 439/607
5,267,868 * 12/1993 Wolff, Jr. ..... 439/607
5,944,559 * 8/1999 Wu ..... 439/607
6,000,968 * 12/1999 Hagiwara ..... 439/607
6,007,379 * 12/1999 Michaelis et al. ..... 439/607
6,086,421 * 7/2000 Wu et al. ..... 439/607
6,113,427 * 9/2000 Wu ..... 439/607

* cited by examiner

*Primary Examiner*—Brian Sircus
*Assistant Examiner*—Hae Moon Hyeon
(74) *Attorney, Agent, or Firm*—Staas & Halsey LLP

(57) ABSTRACT

An electrical connector has a connector main unit having terminals extending outward in substantially a straight line from a resin mold disposed therein, a housing shielding the connector main unit, the housing having an opening in a bottom side surface through which the connector main unit is inserted and mounted therein, two opposed sides of the housing being joined along a seam line, and a fixing mechanism formed by fitting together the connector main unit and the housing so that the two opposed sides of the housing do not come apart at the seam line.

14 Claims, 7 Drawing Sheets

ELECTRICAL CONNECTOR HAVING A FIXING MECHANISM AND METHOD FOR MANUFACTURING SAID ELECTRICAL CONNECTOR

BACKGROUND OF THE INVENTION

1. Field of the Invention

The present invention relates generally to an electrical connector, and more particularly, to an electrical connector composed of a connector main unit and a housing, the connector main unit having terminals extending in either substantially a straight line or at substantially a right angle from a substantially box-like resin mold, the housing being substantially box-like, at least a bottom surface of the housing having an opening for the purpose of mounting the connector main unit and at least one of two opposed side walls of the housing being divided into essentially two opposed side wall portions defining a seam line therebetween, the housing being made of a conductive metal material having the function of a shield, the connector main unit fitting inside the housing so as to be covered and shielded by the housing.

2. Description of the Related Art

Although a variety of structures are used as electrical connectors, one common structure is a so-called straight type connector, which consists of a connector main unit and a housing, with the connector main unit having terminals extending in substantially a straight line from a substantially box-like resin mold and the housing being substantially box-like. At least a bottom of the housing has an opening for the purpose of mounting the connector main unit and at least one of two opposed side walls of the housing is divided along a seam line formed on the side wall, the housing being made of a conductive metal material which functions as a shield. The connector main unit fits inside the housing so as to be shielded and covered by the housing. In a straight type connector as described above, the terminals of the mounted connector main unit project from an opening in the bottom of the housing.

Additionally, another common connector main unit-plus-housing structure is the so-called right-angle type connector, in which the terminals of the connector main unit are bent at substantially a right angle and extend from a substantially box-like resin mold, with the housing being substantially box-like. The bottom of the housing and one side wall of the housing adjacent to the bottom are open for the purpose of mounting the connector main unit. The open side wall and another side wall opposite the open side wall are divided into two parts by a seam line formed thereon. The housing is made of a conductive metal material which functions as a shield. The connector main unit fits inside the housing so as to be shielded and covered by the housing. In a right-angle type connector as described above, the terminals of the connector main unit are mounted so as to project from the side wall opening of the housing.

It should be noted that both the straight type connector and the right-angle type connector are two-piece connectors, in which the housing consists of two opposed sides joined together so as to form a seam line.

A description will now be given of the structure of the conventional two-piece straight type connector, with reference to the accompanying drawings.

FIG. 1 is a perspective view from an open bottom side of the conventional connector, in a state in which the connector main unit has been assembled, that is, mounted in the housing. FIG. 2 is a perspective view of the housing from an open bottom side of the conventional connector.

As shown in FIG. 1, the connector main unit 2 of the two-piece connector 1 is composed of a plurality of terminals 3, or contacts, and a box-like resin mold 4 formed from insulating, that is, non-conductive, resin material. One projection 5*a* is formed at substantially a central position of the box-like resin mold 4 and a separate rectangular projection 5*b* is formed on an edge portion of the box-like resin mold 4. Identical projections are formed on a side, not shown in FIG. 1, which is opposite the side on which the projections 5*a* and 5*b* are formed.

Similarly, the housing 7 is formed into a box-like shape, and is open at a bottom side surface so as to accommodate a connector main unit 2. It should be noted that an opening, not shown in the drawing, is also formed in a center portion of a top side, opposite the open bottom side in order to make it possible to connect the connector to other connectors.

A slot 8 is formed in each of two opposed side surfaces of the housing 7 continuous with the bottom side surface opening therein, with a hole 9 formed in a center portion of each of the two opposed side surfaces.

The connector main unit 2 is inserted in the housing 7 through the opening, the projection 5*b* engaging the slot 8, the projection 5*a* engaging the hole 9 and the connector main unit 2 thereby being mounted in the housing 7 to form a single integrated connector 1.

A more detailed description will now be given of the housing 7 and the conventional method by which it is typically formed.

The housing 7 is cut from a single sheet of conductive metal material and then folded so as to assume the substantially box-like form described above. In that state, each of the two opposed sides of the housing 7 described above are formed so as to extend into two sets of extended side portions 7*a*, 7*c* and 7*b*, 7*d*, the extended side portions bent at substantially a right angle with respect to the two opposed sides, side portions 7*a* and 7*b* and side portions 7*c* and 7*d* almost contacting each other and forming a seam line P dividing the housing into two opposed sides as shown in FIG. 2.

When the housing 7 is in the process of being bent into a box-like form the half containing side portions 7*a*, 7*c* is slightly separated from the half containing side portions 7*b*, 7*d*, as shown in FIG. 2. In order to securely join these two opposed sides of the housing a tab portion 6*a* is formed on the half containing side portions 7*a*, 7*c* and a slit portion 6*b* that accommodates the tab portion 6*a* is formed in the other half containing side portions 7*b*, 7*d*. The tab portion 6*a* is inserted in the slit portion 6*b* and this engaged portion is stamped or crimped shut so that the seam line P is fixed and does not open, thus forming the completed housing 7 shown in FIG. 2.

After the housing 7 of the conventional two-piece shielded connector 1 described above is stamped so as not to open along the seam line P but before the connector main unit 2 is inserted and mounted in the housing 7, the housing 7 is immersed in a rotary container containing a plating solution and a plating is formed on the surface of the housing 7.

However, the housing 7, which has been crimped closed, sometimes re-opens during this plating process. Additionally, during shipping and handling of the connector 1, the housing 7 sometimes also re-opens along the seam line P after the connector main unit 2 has been inserted and mounted therein.

Once the housing 7 of the connector 1 has broken open along the seam line P as described above it is not always easy to re-close the housing 7, and in any case doing so constitutes an additional production step that adds time and cost to the production process.

Moreover, the very step of stamping or crimping the housing 7 closed is itself troublesome, and adds time and cost to the production process.

SUMMARY OF THE INVENTION

Accordingly, it is an object of the present invention to provide an improved and useful electrical connector, in which the disadvantages described above are eliminated.

The above-described object of the present invention is achieved by an electrical connector comprising:

a connector main unit having terminals extending outward in substantially a straight line from a resin mold disposed therein;

a housing shielding the connector main unit, the housing having an opening in a bottom side surface through which the connector main unit is inserted and mounted therein, two opposed sides of the housing being joined along a seam line; and a fixing mechanism formed by fitting together the connector main unit and the housing so that the two opposed sides of the housing do not come apart at the seam line.

According to the invention described above, the seam line is not stamped or crimped together but is instead fixedly closed by the engagement of the connector main unit in the housing, providing a more securely closed housing and eliminating the excess time and cost required to re-close housings that have come apart at the seam lines during plating or during shipping and handling. Moreover, the step of stamping or crimping the seam line closed is eliminated, thereby simplifying the production process and reducing production time and costs.

Additionally, the above-described object of the present invention is also achieved by the electrical connector as described above, wherein the fixing mechanism comprises:

a pair of projections formed on each one of two opposed sides of the connector main unit at a bottom edge thereof and extending toward a top side disposed opposite the open bottom side of the connector main unit; and a pair of slots formed on an open bottom side edge of each one of the two opposed sides of the housing so as to be continuous with the opening, one of the pair of slots formed parallel to and on each side of the seam line, the pair of projections engaging the pair of slots in a state in which the connector main unit is inserted in the housing and thereby fixedly mounting the connector main unit in the housing in such a way that the housing does not come apart along the seam line.

According to the invention described above, a connector in which the connector main unit is securely mounted in the housing can be provided.

Additionally, the above-described object of the present invention is also achieved by the electrical connector as described above, wherein a tip portion of each one of the projections is tapered so as to widen toward a trailing edge side of the connector main unit in a direction opposite a direction of insertion of the connector main unit in the housing and narrow toward a tip on a leading edge side of the projections, an opening edge portion of each one of the slots being tapered so as to widen toward an exterior and narrow toward an interior of the slot.

According to the invention as described above, tapering the tips of the projections and the openings of the slots makes it easier to insert the connector main unit in the housing.

Additionally, the above-described object of the present invention is also achieved by the electrical connector as described above, wherein a plurality of inwardly curved clamp tabs extend from edges of the open bottom side of the housing, an inner side of each one of the inwardly curved clamp tabs being continuous with one of the slots formed in the housing so as to guide the insertion of the projections of the connector main unit into the slots of the housing.

According to the invention described above, providing inwardly curved clamp tabs makes it easier to insert the connector main unit in the housing.

Additionally, the above-described object of the present invention is also achieved by the electrical connector as described above, wherein the fixing mechanism further comprises a side of the housing on which the seam line is disposed being elastically bent inward, the inwardly bent side of the housing pressing upon the connector main unit in a state in which the connector main unit is inserted in the housing in such a way that the housing does not come apart along the seam line.

Additionally, the above-described object of the present invention is also achieved by the electrical connector as described above, wherein the fixing mechanism comprises:

a groove extending longitudinally along a center of each one of two opposed sides of the connector main unit; and an inwardly-bent L-shaped flexible edge ridge extending longitudinally along a seam-line edge of each one of the two opposed sides of the housing, the inwardly-bent L-shaped flexible edge ridge engaging the groove in a state in which the connector main unit is inserted in the housing and thereby fixedly mounting the connector main unit in the housing in such a way that the housing does not come apart along the seam line.

According to the invention described above, a connector in which the connector main unit is securely mounted in the housing can be provided. In particular, the fixing mechanism as described above provides an even more secure mounting of the connector main unit in the housing than is the case with a projection-and-slot-type fixing mechanism like that described above.

Additionally, the above-described object of the present invention is also achieved by the electrical connector as described above, wherein the fixing mechanism further comprises:

a side projection formed on each one of two opposed sides of the connector main unit, the sides being other than the sides on which the groove is formed; and a hole formed on each one of two opposed sides of the housing, the sides being other than the sides on which the ridge is formed, the side projections engaging the holes in a state in which the connector main unit is inserted in the housing and thereby fixedly mounting the connector main unit in the housing in such a way that the connector main unit does not come loose from the housing.

According to the invention described above, an electrical connector in which the connector main unit is securely mounted in the housing can be provided.

Additionally, the above-described object of the present invention is also achieved by a method of manufacturing an electrical connector, the electrical connector comprising:

a connector main unit having terminals extending outward in substantially a straight line from a resin mold disposed therein;

a housing shielding the connector main unit, the housing having an opening in a bottom side surface through which the connector main unit is inserted and mounted therein, two opposed sides of the housing being joined along a seam line; and a fixing mechanism formed by fitting together the connector main unit and the housing so that the two opposed sides of the housing do not come apart at the seam line, the method comprising the steps of:

cutting the housing in a predetermined pattern from a single sheet of metal;

folding the cut housing in a predetermined pattern to form a substantially box-like shape;

immersing the folded housing in a plating solution so as to form a plated layer on the surface of the housing;

removing the housing from the plating solution; and fixing the seam line in the housing by said fixing mechanism so that the two opposed sides of the housing do not come apart at the seam line.

According to the invention described above, an electrical connector in which the connector main unit is securely mounted in the housing can be provided.

Other objects, features and advantages of the present invention will become more apparent from the following detailed description when read in conjunction with the accompanying drawings.

DESCRIPTION OF THE PREFERRED EMBODIMENTS

A description will now be given of embodiments of the present invention, with reference to the accompanying drawings, specifically in the first instance FIGS. 3, 4, 5, 6 and 7.

Figure 1:
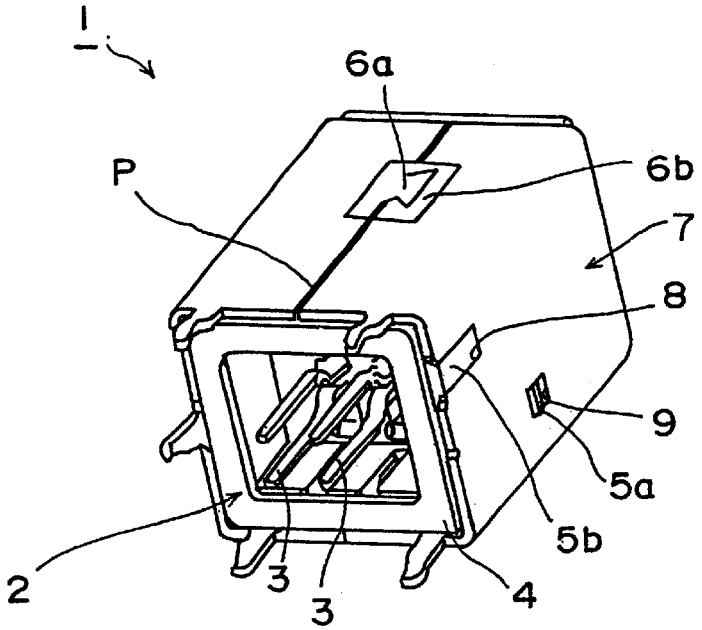
FIG.1 PRIOR ART
FIG. 1 is a perspective view from an open bottom side of the conventional connector, in a state in which the connector main unit has been mounted in the housing.
Figure 2:
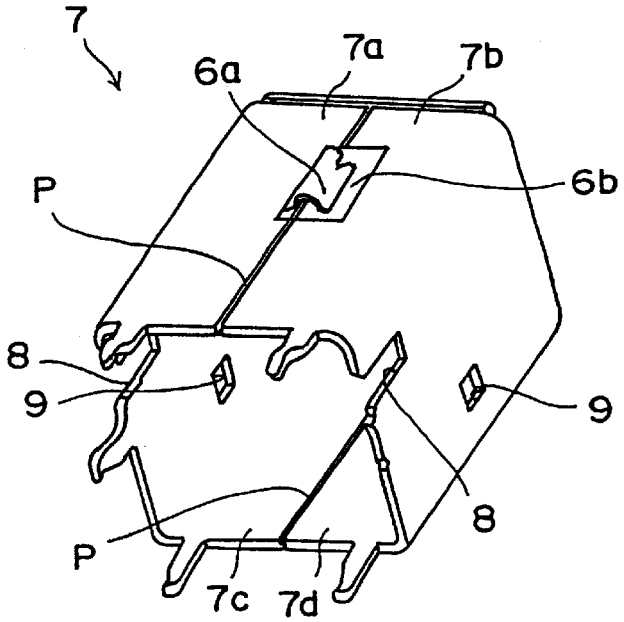
FIG.2 PRIOR ART
FIG. 2 is a perspective view of the housing from an open bottom side of the conventional connector.
Figure 3:
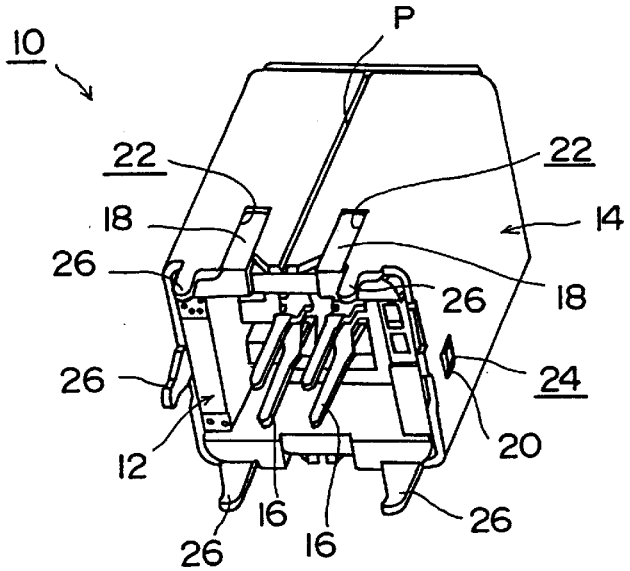
FIG. 3 is a perspective view of a first embodiment of the connector according to the present invention from an open bottom side.

FIG. 3 is a perspective view of a first embodiment of the connector according to the present invention, from an open bottom side. As shown in FIG. 3, a connector 10 is a two-piece straight type connector, comprising a substantially box-like connector main unit 12 and a similarly substantially box-like housing 14. A plurality of terminals 16, or contacts, are provided on the connector main unit 12 and disposed in such a way as to project from an open bottom surface of the housing 14, and in that state the connector main unit 12 is mounted, or assembled, in the housing 14.

For the orientation of the connector 10 shown in FIG. 3, a first pair of rectangular-shaped projections 18 are provided at a center portion of a side surface of the connector main unit 12. A second, tapered side projection 20 is formed on a right side surface. Similarly, although not shown in the drawing, identical rectangular-shaped projections 18 and a tapered side projection 20 are formed at identical locations on a center portion of an opposite side surface and a left side surface, respectively, of the housing 14.

Likewise, a pair of rectangular slots 22 are formed, one on each side (i.e., on respective, opposite sides) of a seam line P at a center portion of a side surface of the housing 14, parallel to the seam line P. Additionally, a hole 24 is formed in the right side of the housing 14 near the open bottom thereof. Similarly, although not shown in the drawing, identical slots 22 and an identical hole 24 are formed at identical locations on a center portion of an opposite side and a left side surface, respectively, of the housing 14.

The connector main unit 12, which is inserted in the housing 14 from the opening in the bottom of the housing 14, is fixedly mounted in the housing by the projections 18 engaging the slots 22 and the side projection 20 engaging the hole 24, thereby also closing the seam line P.

Figure 4:
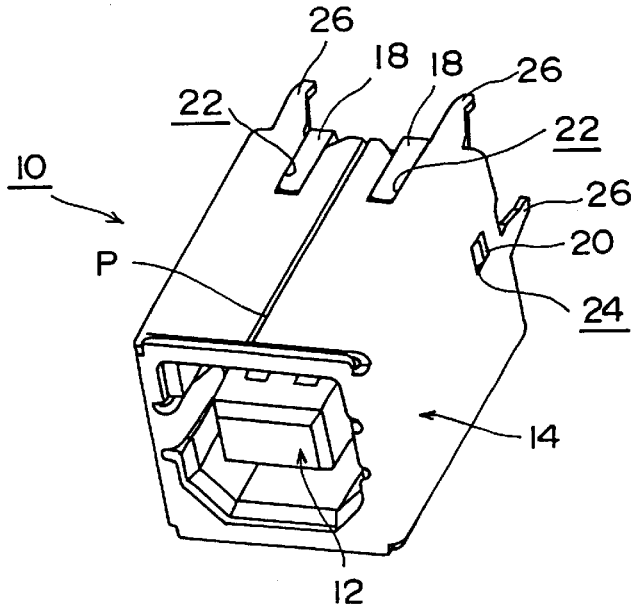
FIG. 4 is a perspective view of a first embodiment of the connector according to the present invention from a side opposite the side shown in FIG. 3.
Figure 5:
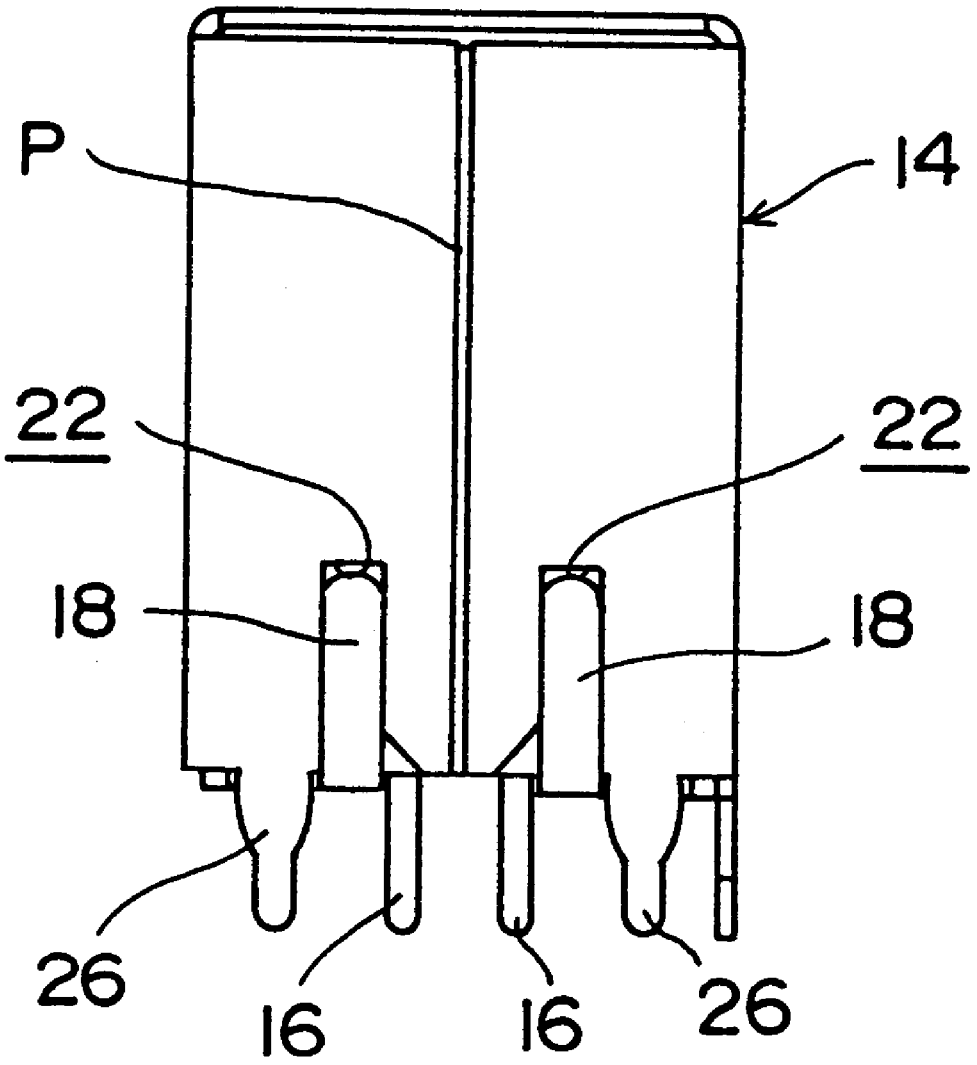
FIG. 5 is an elevational view of a first embodiment of the connector according to the present invention.

FIG. 4 is the perspective view of a first embodiment of the connector according to the present invention from a side opposite the side shown in FIG. 3. FIG. 5 is the top side view of a first embodiment of the connector according to the present invention. As shown in FIG. 4, a top center surface of the housing 14 opposite the surface from which the terminals 16 of the connector 12 project is open so as to enable connection of the connector 10 with other connectors.

Additionally, as shown in FIGS. 3, 4 and 5, a plurality of inwardly curved clamp tabs 26 are formed on each bottom edge of the housing 14 so as to enclose, or extend across, the open bottom surface of the housing 14. These inwardly curved clamp tabs 26 become engaging members when connecting the connector 10 to electronic components not shown in the drawing. These inwardly curved clamp tabs 26 are formed so as to bend slightly outwardly near a tip portion thereof before bending inwardly again at the tip portion. It should be noted that, as shown in FIG. 5, to enable both the terminals 16 and the inwardly curved clamp tabs 26 to engage the same electronic component printed circuit board (not shown) the tip portions of the terminals 16 and the inwardly curved clamp tabs 26 are formed to extend from the bottom surface of housing 14 by a common length, such that the respective terminal ends thereof lie in a common horizontal plane.

A more detailed description will now be given of the structure of the connector 10 with reference to FIG. 6, which shows an exploded perspective view of the connector 10 according to a first embodiment of the present invention, the connector 10 comprising a housing 14 and a connector main unit 12 which in turn comprises terminals 16 and a resin mold 28.

Figures 6A, 6B:
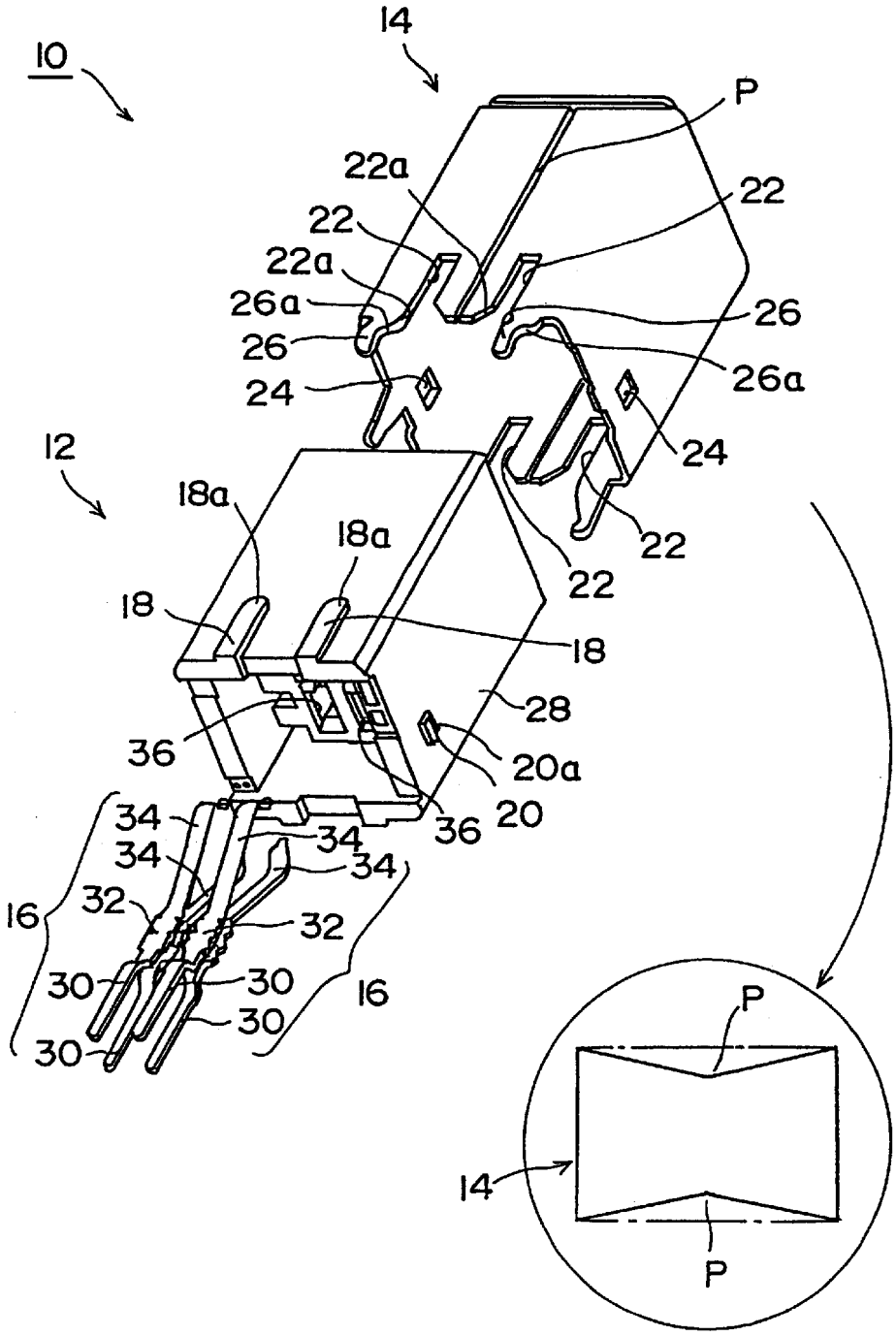
FIG. 6 is an exploded perspective view of a first embodiment of the connector according to the present invention.

As shown in FIG. 6, the connector main unit 12 comprises two terminals 16 composed of conductive material. Each one of the two terminals 16 comprises a pair of connecting portions 30, a center bulge portion 32 continuous with and extending from a tip portion of the connecting portion 30 and a pair of lead portions 34 continuous with and extending from a tip portion of the bulge portion 32.

The resin mold 28 of the connector main unit 12 is formed from insulating material and has a substantially box-like shape. As described previously and as shown in FIG. 6, a pair of rectangular projections 18*a* are formed at rear edge portions of each of two opposing side surfaces of the connector main unit 1, the lower side surface not, however, being shown in the drawing. A tip portion of each one of the projections 18 has an arc-shaped portion 18*a* tapered outwardly in a rearward direction, that is, a direction opposite to the direction of insertion of the connector main unit 12 into the housing 14. Additionally, respective side projections 20 each having a tip portion 20*a* tapered in the rearward direction, are formed on a left side surface and a right side surface of the connector main unit 12, the left side, however, not being shown in the drawing. As shown in FIG. 6, this side projection 20 is provided at a position further in the rearward direction than the tapered tip portions 18*a* of the projections 18. As shown in FIG. 6, the resin mold 28 is open at a bottom surface positioned at a lower left center thereof, with a groove 36 formed at a portion located at a distance from the opening. Respective lead portions 34 of the terminals 16 are inserted into the grooves 36 to form the connector main unit 12.

At the same time, the housing 14, which, as mentioned previously, has a substantially box-like shape, has an open bottom surface so that the connector main unit 12 can be inserted therein. Additionally, an opening is formed in a top surface opposite the bottom surface of the housing 14 so that the connector can be connected to other connectors. Additionally, slots 22 are formed on opposed side surfaces so as to be continuous with the bottom surface opening, the slots equidistant from a seam line P formed on opposed side surfaces as shown in FIG. 6. Each one of the slots 22 has a tapered opening 22*a* which widens in the rearward direction i.e., toward the open, bottom edge. Additionally, a hole 24 is formed in a right side surface and a left side surface. Additionally, a plurality of inwardly curved clamp tabs 26 are formed so as to extend from all bottom side edges of the open bottom of the housing 14, with a tapered portion 26*a* at the junction of the inwardly curved clamp tab 26 with the bottom edge and an inner edge portion of each of the inwardly curved clamp tabs 26 being continuous with the tapered portion 22*a* of an adjacent one of the slots 22 formed in the housing 14 so as to guide the insertion of the projections 18 of the connector main unit 12 into the slots 22 of the housing 14.

A description will now be given of the method of manufacturing the housing 14 and the connector 10 according to the present invention, with reference to FIG. 7, which is a plan view of the housing for a first embodiment of the connector according to the present invention prior to folding.

Figure 7:
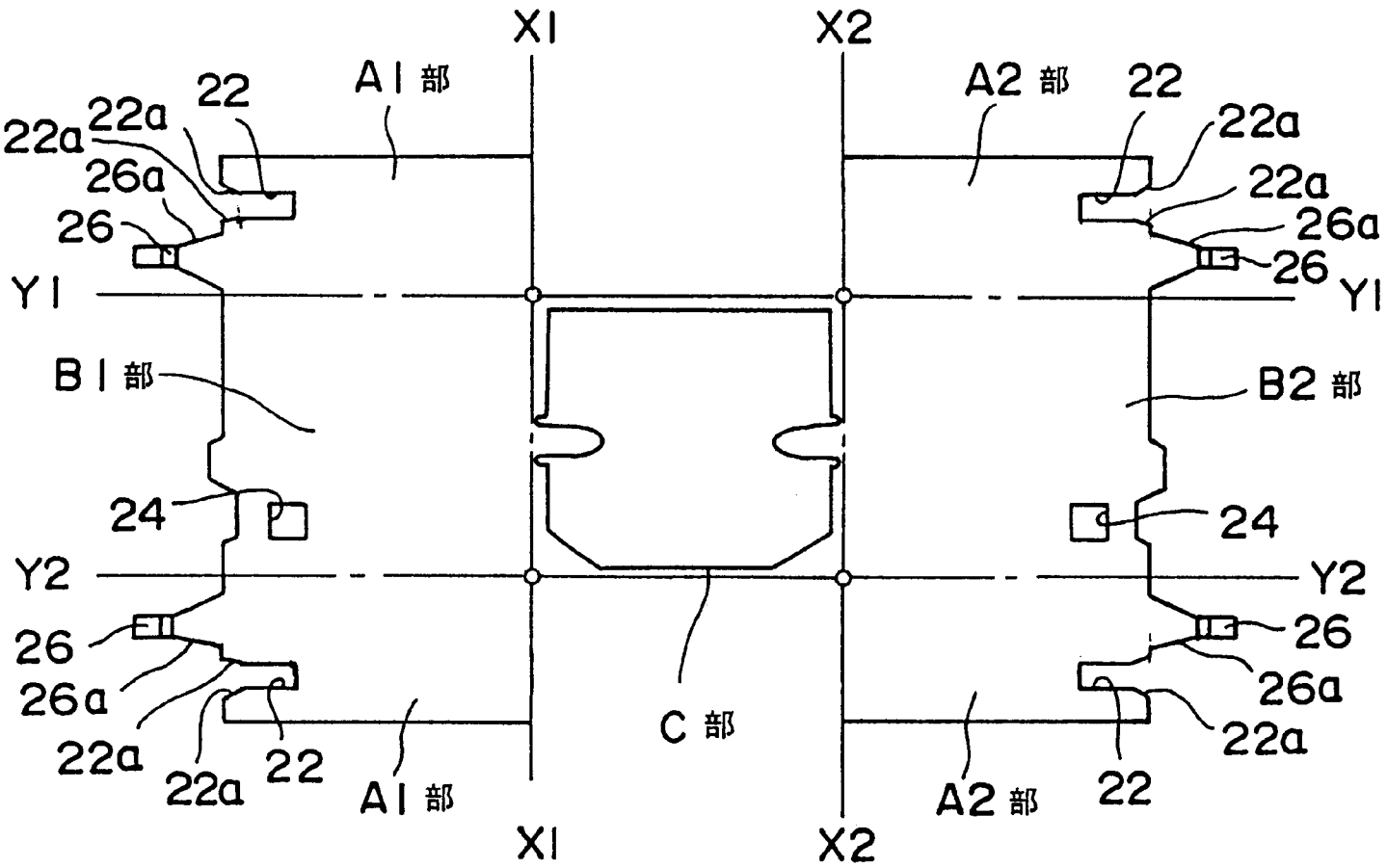
FIG. 7 is a plan view of a housing for a first embodiment of the connector according to the present invention prior to folding.

The housing 14 is first cut from a single sheet of metallic material in the shape shown in FIG. 7. The sheet of metallic material may be made of phosphor bronze. Then, sections A1 and B1 on a left side as shown in the diagram, and sections A2 and B2 on a right side as shown in the diagram, are bent upward at substantially a right angle along the lines X1 and X2, respectively, relatively to the centrally located top frame portion C. Further, sections A1 and A2, hereinafter referred to as partial side walls A1 and A2, respectively, are bent further inward beyond a right angle along lines Y1 and Y2, thus forming the box-like shape of the housing 14.

As will be appreciated from the drawing and the above description, the part formed by sections A1 and B1 and the part formed by A2 and B2, each comprise one half of the housing 14. In this folded state, the edges the partial side walls A1 and A2 contact each other to form the seam line P; further, portion C forms a top frame at the upper surface of housing 14 and respective bottom edges of A1, A2, B1 and B2 define the open bottom, of housing 14; as shown in FIG. 3, FIG. 4 and FIG. 6. Additionally, walls B1 and B2 form left and right side surfaces as shown in FIG. 3, FIG. 4 and FIG. 6. As a result, an opening is formed at the open bottom which would be above and parallel to the surface of the paper on which the diagram is drawn. It should be noted that a section C as indicated in FIG. 7 forms a top wall which has an opening for the connection of this connector 10 to other connectors.

These partial side walls A1 and A2, adjacent edges of which form the seam line P, are laterally separated slightly from each other in a state in which the housing 14 is formed into the box-like shape described previously. Hereinafter this state is referred to as separated seam line P state.

In the separated seam line P state as described above, the housing 14 is immersed in a solder plating solution prior to the insertion of the connector main unit 12 in the housing 14, thus forming a layer of solder plating on the surface of the housing 14.

As discussed above, in the case of the conventional connector the seam line P has already been stamped or crimped closed by the time the housing is immersed in the plating solution. As a result, it sometimes happens that the housing comes apart at the seam line P when the connector is immersed in the plating solution, producing a defective product which is either repaired or discarded.

By contrast, with the connector 10 according to a first embodiment of the present invention, the housing 14 is immersed in the plating solution in the separated seam line P state described above, that is, before being fixedly closed. As a result, even if the housing 14 comes apart along or is displaced with respect to the seam line P, the housing 14 can be easily pressed back into shape by hand if necessary.

Next, in a state in which the solder-plated housing is substantially closed along the seam line P, the connector main unit 12 is inserted into the housing 14 via the open bottom of the housing 14 described above, with the tapered portions 18*a* of the projections 18 being guided by the tapered portions 26*a* of the inwardly curved clamp tabs 26 so as to easily engage and enter the tapered portions 22*a* of the slots 22, thus fixedly closing the seam line P so that the seam line P does not open.

Additionally, as described above, the two sides of the housing 14 are bent inward at more than a right angle, so an upper side surface of the connector main unit 12 is pressed upon, thus securely closing the seam line P.

Additionally, after the seam line P has been fixedly closed, the projections 20 described above of the connector main unit 12 inserted in the housing 14 via the open bottom above are easily inserted into and engaged by the corresponding holes 24, thus completing the assembly of the connector 10 according to the first embodiment of the present invention, in which the connector main unit 12 is securely mounted in the housing 14. It will be appreciated by those skilled in the art that in the completed connector 10, as described above, the seam line P is securely closed and thus the housing 14 will not come apart along the seam line P during shipping and handling.

Next, a description will be given of a second embodiment of the connector according to the present invention, with reference to FIG. 8.

Figure 8:
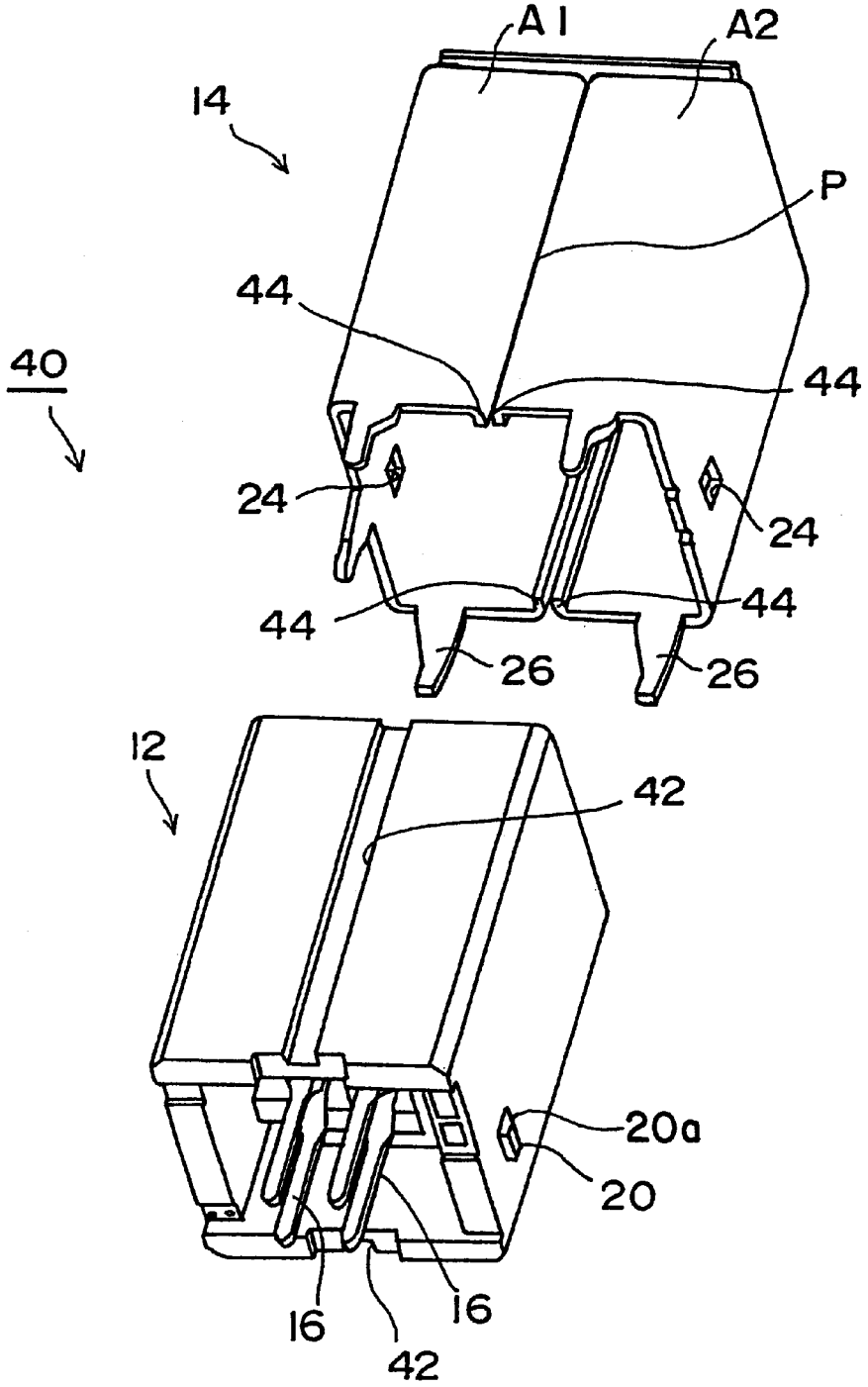
FIG. 8 is an exploded perspective view of a second embodiment of the connector according to the present invention.

FIG. 8 is an exploded perspective view of a second embodiment of the connector 40 according to the present invention. The basic structure of the connector 40 is identical to that of the connector 10 of the first embodiment described above, comprising a substantially box-like connector main unit 12 and a substantially box-like housing 14, with the connector main unit 12 mounted in the housing 14 in a state in which a plurality of terminals 16 provided on the connector main unit 12 project in substantially a straight line from the open bottom of the housing 14. A side projection 20 is formed in each one of two opposed sides of the connector main unit 12, the side projection 20 having a tapered portion 20*a* and engaging a hole 24 formed in each of two opposed side walls of the housing 14. Additionally, inwardly curved clamp tabs 26 are formed on and extend from edges of each of the side walls of the housing 14 so as to surround open bottom of the housing 14. It should be noted that those parts of the second embodiment of the connector 40 according to the present invention shown in FIG. 8 that are identical to the parts of the first embodiment of the connector according to the present invention as shown in FIGS. 3, 4, 5 and 6 are given identical reference numerals and a description thereof is omitted.

In connector 40, a groove 42 is formed so as to extend longitudinally along a center of each one of two opposed sides of the connector main unit 12 in the direction of insertion of the connector main unit 12 in the housing 14.

Similarly, each one of two opposed partial sides A1 and A2 in FIG. 8, which are disposed at substantially a right angle to the interconnecting side walls in which the holes 24 are formed are further bent inwardly at more than a right angle with respect to the partial side surfaces so as to form a shallow V-shaped cross-section therebetween. Additionally, the conjoined edge portions of each one of these side surfaces A1 and A2 is bent flexibly inward at substantially a right angle so as to together form an edge ridge 44 having an L-shaped cross-section, said edge ridge 44 hereinafter referred to as an inwardly-bent L-shaped flexible edge ridge 44.

The inwardly-bent L-shaped flexible edge ridges 44 formed in the housing 14 are inserted into and engage the respective grooves 42 formed in the connector main unit 12, making the insertion and mounting of the connector main unit 12 in the housing 14 easy and secure. As a result, the seam line P is securely closed so that the housing does not come apart along the seam line P, thus providing the same advantage as that provided by the first embodiment described above.

It should be noted that the electrical connector according to the above-described first embodiment of the present invention and the electrical connector according to the above-described second embodiment of the present invention may be combined in a single separate embodiment.

Next, a description will be given of a third embodiment of the connector according to the present invention, with reference to FIG. 9.

Figure 9:
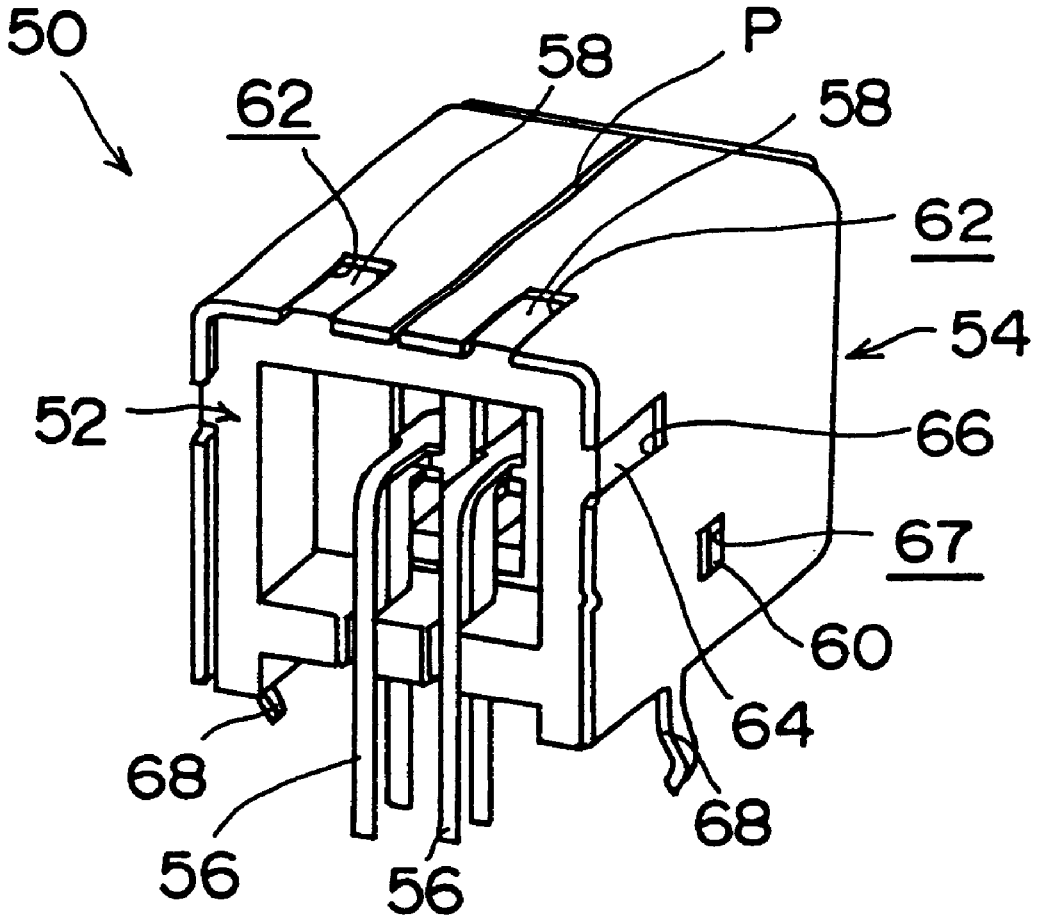
FIG. 9 is a perspective view from an open bottom side of a third embodiment of the connector according to the present invention.

FIG. 9 is a perspective view from an open bottom of a third embodiment of the connector 50 according to the present invention. As shown in the diagram, the connector 50 is a two-piece right-angle type connector, comprising a substantially box-like connector main unit 52 and a substantially box-like housing 54, with the connector main unit 52 mounted in the housing 54 in a state in which a plurality of terminals 56 provided on the connector main unit 52 project at substantially a right angle from, and adjacent to the open bottom of the housing 54.

As shown in FIG. 9, a pair of projections 58 are formed in each one of two opposed side surfaces of the connector main unit 52 (the upper and lower such side surfaces as seen in FIG. 9), only that pair of projections 58 provided on the upper side surface is shown in the diagram. Additionally, a separate rectangular projection 64 and yet another separate projection 60 having a tapered portion are provided on a right side wall of the connector main unit 52, with identical projections 64 and 60 being formed on an opposed left side wall of the connector main unit 52.

Similarly, a pair of slots 62 are formed in side wall of the housing 54 (upper side wall in FIG. 9), equidistant from and on either side of a seam line P extending longitudinally along a center of the side wall, the opening of the slots 62 being continuous with the open bottom of the housing 54. Additionally, a slot 66 continuous with open bottom of the housing 54 is formed on a right side of the housing 54, and, separately, a hole 67 is formed at a position near the open bottom surface of the housing 54. An identical slot 66 and hole 67 are also formed on an opposed side surface of the housing 54, although these are not visible from the angle presented in the drawing and hence are not shown therein.

Additionally, a plurality of inwardly curved clamp tabs 68 are formed on edge portions of left and right sides of a lower side surface of the housing 54 so as to enclose the opening in the lower side surface of the housing 54. The two partial side walls of the above-described housing between which the seam line P is located are bent inward at greater than a right angle with respect to the two interconnecting sides on which the seam line P is not located, in such a way as to press in upon the corresponding side surfaces of the connector main unit 52 in a state in which the connector main unit 52 is inserted into and mounted in the housing 54.

When the connector main unit 52 is inserted into the housing 54, the pair of projections 58 provided on the connector main unit 52 engage the pair of slots 62 provided in the housing 54, closing the seam line P at the same time as the connector main unit 52 is pressed by the inwardly-bent sides of the housing 54. Similarly, the rectangular projection 64 of the connector main unit 52 engages the slot 66 in the housing 54. As a result, the connector main unit 52 is securely mounted in the housing 54. Additionally, the projection 60 of the connector main unit 52 engages the hole 67 in the housing 54, so the connector main unit 52 does not come loose from and slip out of the open bottom of the housing 54.

The above description is provided in order to enable any person skilled in the art to make and use the invention and sets forth the best mode contemplated by the inventors of carrying out their invention.

The present invention is not limited to the specifically disclosed embodiments, and variations and modifications may be made without departing from the scope of the present invention.

The present application is based on Japanese Priority Application No. 11-057613, filed on Mar. 4, 1999, the entire contents of which are hereby incorporated by reference.

What is claimed is:

1. An electrical connector, comprising:

a connector main unit having a top and a bottom interconnected by opposed sides and terminals extending outwardly from the bottom in substantially a straight line from a resin mold disposed therein;

a housing having first and second opposed sides integrally connected to and extending transversely from a top thereof, respective bottom edges of the first and second opposed sides defining an open bottom and the first and second opposed sides having respective pairs of first side edges and second side edges adjacent to but separated from each other along respective first and second seam lines, the housing receiving the connector main unit through the open bottom side surface; and a fixing mechanism formed by fitting together the connector main unit and the housing so that the two opposed sides of the housing do not come apart at the seam lines, wherein the fixing mechanism comprises:

a pair of projections formed on each of two opposed sides of the connector main unit extending from respective bottom edges thereof and toward the top thereof;

a pair of slots formed in each of the two opposed sides of the housing extending from the respective bottom edges thereof, so as to be continuous with the open bottom, and toward the top of the housing and aligned with the respective pairs of projections of the corresponding two opposed sides of the connector main unit, parallel to and on each side of the seam lines, and the pairs of slots receiving the corresponding pairs of projections therein as the connector main unit is inserted into the housing at the open bottom thereof and thereby fixedly mounting the connector main unit in the housing and securing the opposed sides of the housing at the respective first and second side edges thereof in fixed relationship along the respective first and second seam lines.

2. The electrical connector as claimed in claim 1, wherein each of the projections has a tapered tip portion at a leading edge thereof in the direction of insertion of the connector main unit into the housing.

3. The electrical connector as claimed in claim 2, further comprising a plurality of inwardly curved clamp tabs extending from bottom edges of the first and second opposed sides of the housing, an inner side of each inwardly curved clamp tab being continuous with a corresponding one of the slots formed in the housing so as to guide the insertion of the projections of the connector main unit into the corresponding slots of the housing.

4. The electrical connector as claimed in claim 1, wherein the fixing mechanism further comprises:

a side projection formed on each of a second pair of two opposed sides of the connector main unit, the second pair of two opposed sides being other than the first pair of two opposed sides on which the pairs of projections are formed; and a hole formed in each of the two opposed sides of the housing; and the side projections engaging the respective holes in a state in which the connector main unit is inserted into the housing and thereby fixedly mounting the connector main unit in the housing in such a way that the connector main unit does not come loose from the housing.

5. The electrical connector as claimed in claim 1, wherein the fixing mechanism further comprises inwardly bent portions of the first and second side edges of each of the first and second opposed sides, disposed adjacent to but separated from each other along the respective first and second seam lines, pressing upon the connector main unit, in a state in which the connector main unit is inserted into the housing, in such a way that the housing does not come apart along the seam line.

6. The electrical connector as claimed in claim 1, wherein the housing is made of conductive metallic material.

7. The electrical connector as claimed in claim 6, wherein the conductive metallic material is phosphor bronze.

8. An electrical connector, comprising:

a connector main unit having a top and a bottom interconnected by opposed sides and terminals extending outwardly from the bottom and then bent downwardly at substantially a right angle from a resin mold disposed therein;

a housing having first and second opposed sides integrally connected to and extending transversely from a top thereof, respective bottom edges of the first and second opposed sides defining an open bottom and the first and second opposed sides having respective pairs of first side edges and second side edges adjacent to but separated from each other along respective first and second seam lines, the housing receiving the connector main unit through the open bottom; and a fixing mechanism formed by fitting together the connector main unit and the housing so that the two opposed sides of the housing do not come apart at the seam line, wherein the fixing mechanism comprises.

a first pair of projections formed on a first opposed side of the connector main unit, extending from a bottom edge thereof and toward the top, a first pair of slots formed in one of the first and second opposed sides of the housing so as to be continuous with the bottom edge, the first pair of slots disposed on a side of the housing on which the seam line is located and so as to be equidistant from and parallel to the seam line, and the first pair of projections engaging the first pair of slots in a state in which the connector main unit is inserted in the housing and thereby fixedly mounting the connector main unit in the housing in such a way that the housing does not come apart along the seam line.

9. The electrical connector as claimed in claim 8, wherein the fixing mechanism further comprises:

a second pair of projections formed in a second opposed side of the connector main unit, extending from a bottom edge thereof, and toward the top; and a second pair of slots formed in the other of the first and second opposed sides of the housing so as to be continuous with the open bottom edge, the second pair of projections engaging the second pair of slots in a state in which the connector main unit is inserted in the housing so that the housing does not come apart along the seam line.

10. The electrical connector as claimed in claim 8, wherein the fixing mechanism comprises:

side projection formed on each one of the two opposed sides of the connector main unit; and a hole formed in each one of the first and second opposed sides of the housing, the sides being other than the side on which the seam line is located, the projections engaging the holes in a state in which the connector main unit is inserted in the housing and thereby fixedly mounting the connector main unit in the housing in such a way that the connector main unit does not come loose from the housing.

11. The electrical connector as claimed in claim 8, wherein the housing is made of conductive metallic material.

12. The electrical connector as claimed in claim 11, wherein the conductive metallic material is phosphor bronze.

13. An electrical connector, comprising:

a connector main unit comprising a resin mold body;

a housing formed of a folded, patterned metal sheet comprising a central frame portion of rectangular configuration having first and second opposed edges integral with respective first and second side wall forming portions each comprising an interconnecting sidewall and a pair of partial sidewalls, bent along respective, opposed edges of the interconnecting sidewall by at least 90E relatively to the respective interconnecting side wall such that each pair of partial side walls extends transversely to the frame and in substantially parallel relationship and with longitudinal edges thereof in closely spaced relationship defining a seam line therebetween, bottom edges of the sidewalls defacing an open bottom of the housing; and the resin mold body having a pair of longitudinal projections on each of a first pair of opposing sidewalls thereof and each of the associated pairs of partial sidewalls having an elongated slot therein positioned so as to be aligned with a corresponding longitudinal projection and to receive same therein as the connector main unit is inserted into the housing along a direction of insertion, the pair of projections maintaining and fixing the relative positions of the associated pair of partial sidewalls and resisting separation thereof along the seam line.

14. The electrical connector as claimed in claim 13, further comprising:

a further projection on each of a second pair of opposing sidewalls, different from the first pair thereof; and a hole in each of the interconnecting sidewalls of the housing, positioned therein so as to be aligned with and to receive the further projection therein as the connector main unit is inserted fully into the housing along the direction of insertion.

* * * * *

UNITED STATES PATENT AND TRADEMARK OFFICE

CERTIFICATE OF CORRECTION

PATENT NO. : 6,322,394 B1
DATED : November 27, 2001
INVENTOR(S) : Satoshi Katoh et al.

It is certified that error appears in the above-identified patent and that said Letters Patent is hereby corrected as shown below:

Column 12,
Line 52, insert -- a -- before "side".

Signed and Sealed this

Twenty-sixth Day of March, 2002

*Attest:*

*Attesting Officer*

JAMES E. ROGAN
*Director of the United States Patent and Trademark Office*